United States Patent [19]

Nitschmann et al.

[11] Patent Number: 4,558,621

[45] Date of Patent: Dec. 17, 1985

[54] SAW CHAIN FOR A CHAIN SAW

[75] Inventors: Karl Nitschmann, Schorndorf; Wilfried Linke, Winnenden; Günter Dietzsch, Waiblingen-Hohen; Werner Hartmann, Ostfildern; Hans-Georg Kaiser, Köngen; Werner Meyle, Murr; Hans Dolata, Waiblingen-Neustadt, all of Fed. Rep. of Germany

[73] Assignee: Andreas Stihl, Waiblingen, Fed. Rep. of Germany

[21] Appl. No.: 633,196

[22] Filed: Jul. 23, 1984

[30] Foreign Application Priority Data

Jul. 23, 1983 [DE] Fed. Rep. of Germany ..... 3326643

[51] Int. Cl.[4] ..... B27B 33/14

[52] U.S. Cl. ..... 83/834; 83/830

[58] Field of Search ..... 83/830–834

[56] References Cited

U.S. PATENT DOCUMENTS 4,425,830 1/1984 Atkinson ..... 83/834

4,459,890 7/1984 Dolata ..... 83/834

*Primary Examiner*—James M. Meister

*Attorney, Agent, or Firm*—Walter Ottesen

[57] ABSTRACT

The invention is directed to a saw chain for a motor-driven chain saw which includes cutting links, side connecting links, driving links and safety links. Each safety link has an upper edge defining a wave-like contour that prevents chips from accumulating during the cutting action. The cutting links and safety links of the saw chain are arranged with respect to each other so that overlap is avoided between the tail end of the rearward projection of the safety link and the forward projection of the depth limiter of the cutting tooth. This affords the advantage that cutting chips do not become jammed therebetween.

14 Claims, 4 Drawing Figures

1
2
3
4
5
6
7
7'
9
11
11'
12
12'
13
14
15'
16
17
20
21
A
A'
X
X'
H
T'
M
M'
R
a 1
3
4
6
7
7'
8
9
17
17'
17''

SAW CHAIN FOR A CHAIN SAW

FIELD OF THE INVENTION

The invention relates to a saw chain equipped with a safety link and is for use with a motor-driven chain saw.

BACKGROUND OF THE INVENTION

In a saw chain of the aforementioned type which is known from German published patent application DE-OS No. 3,230,530, a relatively large recess is provided in the body of the safety link to reduce kickback. This recess subdivides the safety link into a rearward and a forward projection. It is a disadvantage in this arrangement that chips may accumulate or become trapped in this deep recess of the safety link, resulting in a relatively high chip compression in this particular area which substantially increases friction between the chain and the kerf cut into the wood, the friction consuming a part of the motor output.

It is a further disadvantage of this known arrangement that the circle described by the rearward projection of the safety link protrudes beyond the circle described by the cutting tip of the edge of the cutting tooth, which necessitates an increased thrust in plunge-cutting operations and, as a result, reduces the plunge-cutting speed.

SUMMARY OF THE INVENTION

It is an object of the invention to avoid the disadvantages of the known saw chain and to configure the safety link to largely prevent chip particles from accumulating in the middle area of the safety link and to provide the upper edge of the safety link with a contour permitting a low-friction support of the safety link against the bottom of the kerf.

The saw chain of the invention reduces the friction between the chain and the kerf. The effective motor output is thus not subject to such friction losses. Because it has a relatively large continuous base surface, the safety link of the invention has a comparatively large moment of resistance providing it with improved stability. At the same time, the wave-like contour of the upper edge of the safety link prevents chips from accumulating in a single deep recess during the cutting action or, as a result of their length, from becoming wrapped laterally around the rearward projection adjacent to the deep recess, which gives rise to another jammed condition or at least to a further high friction condition between the flanks of the rearward projection of the safety link and the side walls of the kerf.

In a preferred embodiment of the invention, overlapping between the tail end of the rearward projection of the safety link and, when viewed in the direction of movement, the forward projection of the depth limiter of the cutting tooth is avoided. This affords the added beneficial result that cutting chips do not become jammed in an otherwise existing gap caused by the overlap and eliminates the risk of increased friction and thus of a further reduction in cutting efficiency.

Finally, the wave-like configuration of the upper edge of the safety link affords the advantage of making available an optimum chip space, though restricted in volume. At the same time, chips collecting in the relatively small or low clearances of the wave troughs can be directed away laterally so that chip buildup is not allowed to occur because the configuration of the invention provides for the removal of chips as they occur.

The invention will be described in more detail in the following. Further features of the invention will become apparent from this description, the drawing and the appended claims.

BRIEF DESCRIPTION OF THE DRAWING

The invention will now be described with reference to the drawing wherein.

DESCRIPTION OF THE PREFERRED EMBODIMENTS OF THE INVENTION

Figure 1:
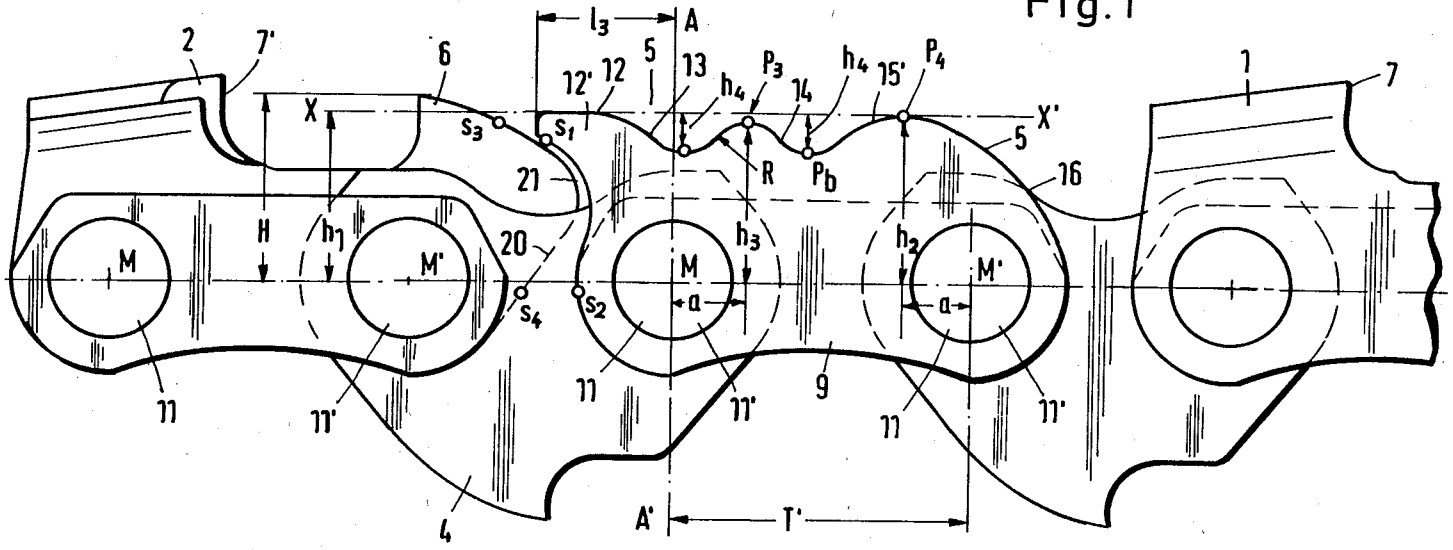
FIG. 1 is a side elevation view of a segment of the saw chain of the invention.
Figure 2:
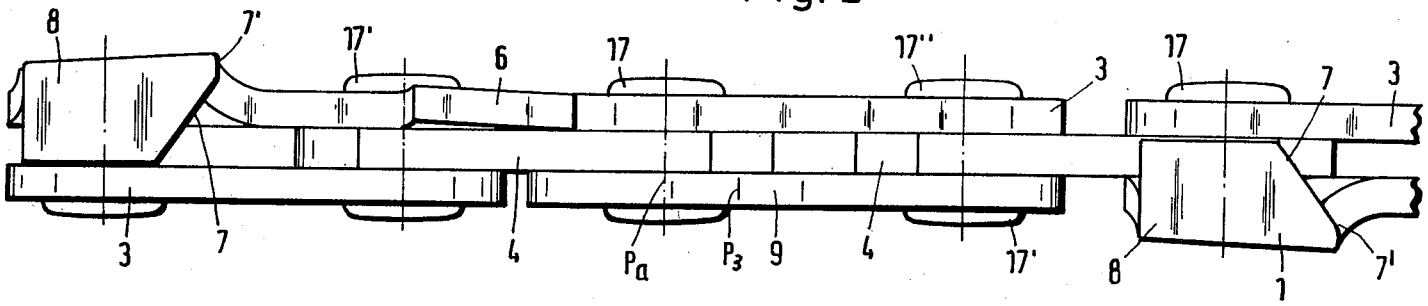
FIG. 2 is a top elevation view of the segment of the saw chain of FIG. 1.
Figure 3:
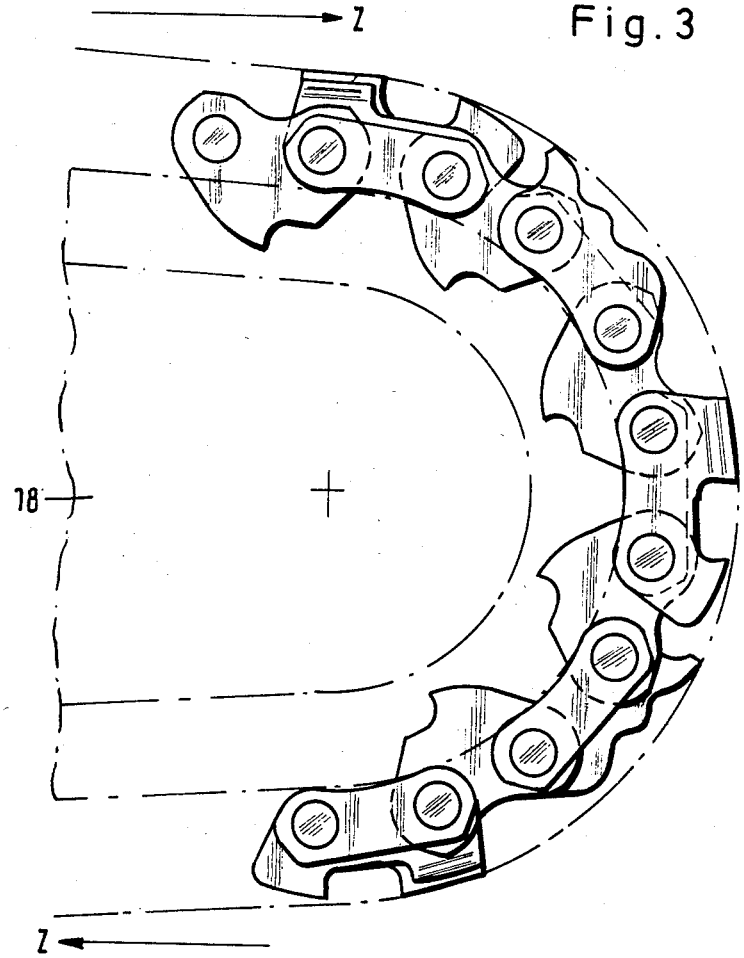
FIG. 3 is a side elevation view of a section of the saw chain of the invention as it moves over the end portion of a guide bar of a motor-driven chain saw; and, FIG. 4 is an enlarged side elevation view of a safety link of the saw chain of the invention.
Figure 4:
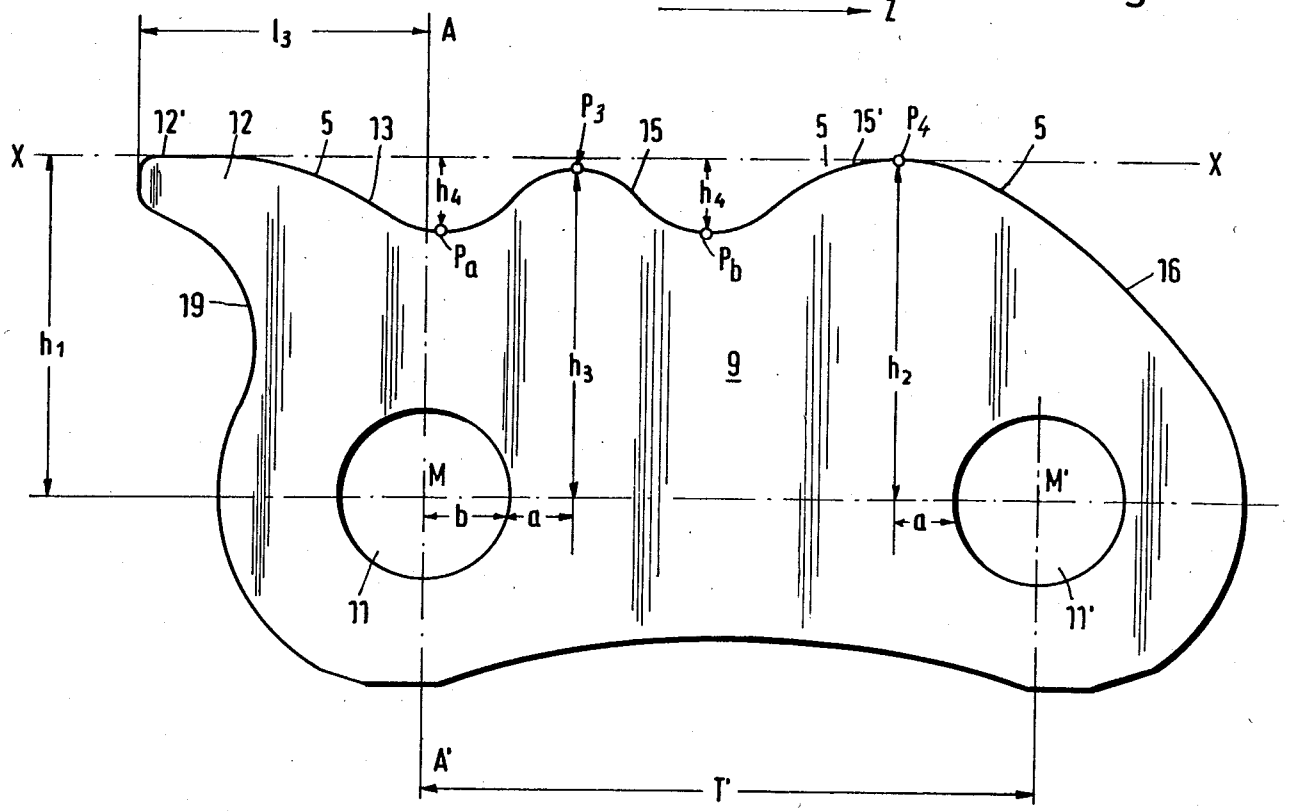

The saw chain illustrated in the drawing is driven by a motor-driven chain saw (not shown). It runs on a cutter bar 18 secured to the motor housing in the direction of arrow Z (FIG. 3). The saw chain includes a plurality of righthand and lefthand cutting links 1, 2 which are pivotally interconnected to intermediate links, namely: lateral connecting links 3, drive links 4 and safety links 9, by rivets 17 engaging through suitable rivet openings 11, 11'.

The saw chain is configured such that the cutting links 1, 2 have connecting links 3 arranged in parallel on opposite sides of the saw chain, and that a safety link 9 is provided between every two consecutive drive links 4. In this arrangement, adjacent drive links 4 are connected by the rearward rivet 17', when viewed in the direction Z of chain movement, with the corresponding forward rivet opening of cutting link 2 and the forward rivet opening of the connecting link 3 adjacent the cutting link. The forward rivet or pivot pin 17 extends through the rivet opening 11 in the rearward portion of safety link 9 as well as through the rearward opening of the adjacent connecting link 3.

When viewed in the direction of movement Z, the forward rivet opening 11' of safety link 9 is directly opposite the forward rivet opening of the adjacent connecting link 3 and directly opposite the rearward rivet opening of the drive link 4, these links being pivotally connected with each other by means of rivet 17''.

Each cutting link 1, 2 has a cutting tooth 7 including a forward cutting edge 7' and a rearwardly inclined roof 8. Disposed ahead of the cutting tooth is an upwardly extending depth limiter 6 which in the embodiment shown is integrally formed with the cutting tooth; it is to be understood that the depth limiter may also be configured as a discrete component.

The forward cutting edge 7' extends in elevation beyond the maximum height of the depth limiter 6 and the depth limiter has its highest point at a vertical maximum distance H from the center-to-center line M, M'. This highest point defines the rearward end point of the depth limiter. From this point forward, the upper edge of the depth limiter 6 extends in a protruding arc over and beyond the forward rivet opening 11'. In the drawing, points $s_3$ and $s_4$ approximately designate the convex area of this arcuate shape in the forward portion of depth limiter 6 of cutting link 2.

The safety link 9 shown in FIGS. 1 to 4 includes an upper edge 5 having a profile defining a continuous curve having at least two waves. The continuous curve starts from the rearward projection 12 of safety link 9 when viewed in the direction of movement Z of the chain and forms a first wave trough 13. The lowest point $P_a$ of wave trough 13 is not lower than five-tenths (5/10) of the maximum height $h_1$ of the rearward projection 12 of the safety link. The maximum height $h_1$ is understood to be the distance between the straight line connecting the centers M, M' of the rivet openings 11, 11' of safety link 9 and a parallel line X–X' extending tangentially to the highest point 12' of projection 12.

The lowest point $P_a$ of the downwardly extending wave portion of projection 12 (wave trough 13) marks a first turning point in the wave-like outline of the upper edge 5 of the safety link. It is followed by a full wave including an ascending portion $P_a$–$P_3$ and a descending portion $P_3$–$P_b$. Thus, the full wave extends between the low points $P_a$ and $P_b$ on edge 5. The highest point $P_3$ of this full wave is below the highest point 12' of rearward projection 12 so that a sufficient distance exists between the bottom of the kerf and the convex maximum of the full wave.

Another wave extends from the forward second low point $P_b$ of full wave $P_a$–$P_b$ when viewed in the direction of movement. The crest of this wave is at the forward maximum point $P_4$ and is in the forward half of safety link 9. The maximum point $P_4$ extends at most up to the aforementioned parallel line X–X'. From this forward maximum point $P_4$, the upper edge 5 descends towards the forward end of the safety link in a convex arc 16 down to the level of the forward rivet opening 11' and continues from there parallel to, and at a sufficient distance from, the rivet opening 11'.

This wave-like configuration of the upper edge 5 provides the body of the safety link with a surface sufficiently large to adequately withstand mechanical stresses, strains and loads occurring particularly in plunge-cutting operations or when encountering branches, et cetera. At the same time, the defined shape and the predetermined spacings of points $P_4$ and $P_3$ in relation to the highest point 12' of projection 12 ensure an optimum low friction between the upper edge 5 of the safety link and the kerf bottom, this low friction resulting from a minimum amount of contact surface which is to be considered punctiform in the wave area.

The relatively small wave troughs form consecutive recesses along the edge 5 which avoid a major accumulation of chips. Any chips that may collect are easily directed away laterally as they occur, thus preventing friction losses due to chip accumulation or clogging.

Advantageously, the locations of the two maximum points $P_3$ and $P_4$ of the approximately sinusoidal waveforms of edge 5 in relation to the body of safety link 9 are chosen such that these two points lie in the area between the two rivet openings 11, 11'. In this arrangement, the two maximum points $P_3$ and $P_4$ are preferably at a sufficient distance a, a' from their nearest respective rivet openings 11, 11', so that any pressure forces or thrusts acting on the maximum points $P_3$, $P_4$ are absorbed at an adequate spacing by the solid material of the safety link body.

Further, it will be an advantage if the rearward low point $P_a$ of wave trough 13 is approximately above the rearward rivet opening 11 and the forward lowest point $P_b$ of the full wave is approximately midway between the forward rivet opening 11' and the rearward rivet opening 11.

The maximum height $h_1$ of the rearward projection 12 of the safety link lies approximately between five-sixths (5/6) and nine-tenths (9/10) of the maximum height H (see FIGS. 1 and 4) of the depth limiter. This height $h_1$ is preferably nine-tenths (9/10) of H.

Still further and when viewed in the direction of movement Z, the maximum height of the forward wave 15' is at point $P_4$ and is identified by $h_2$ in the drawing. This height is approximately between seven-tenths (7/10) and nine-tenths (9/10) of the maximum height H of the depth limiter, with $h_2$ being preferably nine-tenths (9/10) of H.

The maximum height of the middle wave crest 15 between points $P_a$ and $P_b$, is equal to or less than half of the sum of heights $h_1$ and $h_2$, preferably however, this height is six-sevenths (6/7) of the maximum height H of the depth limiter. It is thereby ensured that the middle convex part or wave crest 15, located in the area between the centers M, M' of rivet openings 11, 11', does not extend beyond straight line X–X'.

Thus, the maximum point $P_3$ of the full wave between $P_a$ and $P_b$ is at a distance of about one-sixth to one-third, preferably of one-fourth, of the distance T' between the two centers M, M' of rivet openings 11, 11'. This distance of one-sixth or one-third of T', preferably one-fourth of T', is measured from a line perpendicular to the center-to-center line M, M' and drawn through the center of the rearward opening M.

To reduce friction and ensure reliable removal of any chips that may collect in the wave troughs, it is also essential that: firstly, the radius R of the middle convex segment of the full wave $P_a$–$P_b$ that ascends towards wave crest 15 to be in the range of between one-tenth (1/10) and three-tenths (3/10) of T' in the center portion or, more specifically, the upper maximum portion on both sides of point $P_3$, and secondly, that the distance between the low points of the two concave wave segments adjoining either side of the full wave and parallel line X–X', that is, the height $h_4$, to be equal to or greater than two-tenths (2/10) of the height H of depth limiter 6, this latter dimension being preferably at two-tenths (2/10) of H.

The wave-like contour may be configured such that the positions of points $P_a$ and $P_b$ are at different levels within the above-mentioned allowances. For example, height $h_4$ of point $P_a$ may be greater or smaller than height $h_4$ of forward point $P_b$.

Incidentally, the rearward projection 12 of the safety link 9 of the invention protrudes beyond the perpendicular A, A' drawn through the rearward center M of rivet opening 11 by an amount corresponding to five-ninths (5/9) to three-ninths (3/9) of the center-to-center distance T', this projection extending in the opposite direction of movement Z, that is, in the rearward direction. This protruding portion of the rearward projection 12 has been shown to be of optimum configuration if the distance $l_3$ (see FIG. 1) is of the order of four-ninths (4/9) of T'.

In contrast to the continuously descending convex arc segment 16 in the forward portion of safety link 9, that is, in the area of the forward rivet opening 11', the rearward portion of edge 19 defining the tail portion of the body of the safety link is concave. This concave rearward portion of edge 19 corresponds with the adjacent convex arc 20 of the forward portion of depth limiter 6, such that the two arc segments 19 and 20, in particular in the area between points $s_1$, $s_2$ of the safety link and points $s_3$, $s_4$ of the depth limiter are at a minimum spacing 21 from each other, thus avoiding overlapping of the corresponding arc segments 19 and 20.

This minimum spacing 21 between the two arcuate edges 19, 20 (see side elevation view of FIG. 1) prevents the arcuate segments 19, 20 from overlapping when the saw chain, after running around the end portion of the bar 18, returns to the straight line of its run. Jamming of chips in an overlapping space between the arcuate segments 19 and 20 which would contribute to increased friction is thereby avoided.

Accordingly, the invention provides a saw chain in which, compared to known configurations, the friction between saw chain and kerf is optimally low and additional friction resulting from chip buildup in recesses or chip jamming is avoided. At the same time, the invention provides for an overall stabilization of the saw chain during its rotation such that kickback is largely eliminated. The arrangement and configuration of the safety link are also suitable for use with a saw chain in which the positions or the arrangement of the cutting links relative to the intermediate links in the chain assembly differ from the description of the embodiment disclosed herein.

It is understood that the foregoing description is that of the preferred embodiments of the invention and that various changes and modifications may be made thereto without departing from the spirit and scope of the invention as defined in the appended claims.

What is claimed is:

1. A saw chain for a chain saw, the saw chain comprising:

a plurality of cutting links, a plurality of safety links, a plurality of side connecting links, and a plurality of driving links, the links being pivotally interconnected by rivets or the like to define the saw chain with a first portion of said cutting links and a first portion of said safety links being arranged on one side of the saw chain and the remaining portion of said cutting links and the remaining portion of said safety links being arranged on the other side of the saw chain;

each one of the cutting links including: a plate-like body having an upwardly extending rearward bent-over top portion defining the cutting tooth of the cutting link; a forward upwardly extending portion defining the depth limiter of the cutting link; and, said cutting tooth having a cutting edge at an elevation above said depth limiter;

said safety links corresponding to respective ones of said cutting links;

each one of said safety links being pivotally connected at its rearward end to the forward end of the cutting link corresponding thereto and being disposed on a side of the saw chain opposite from the side thereof on which said corresponding cutting link is disposed;

said safety link having a plate-like body with a projection extending outwardly and rearwardly therefrom so as to be at an elevation less than the depth limiter of said corresponding cutting link;

said safety link further having a rearward rivet opening and a forward rivet opening for accommodating two of said rivets, respectively, said rivet openings having centers defining a first line, the highest point of the top edge of said projection being a predetermined elevation ($h_1$) away from said first line;

said safety link having a top edge extending over the length thereof, said top edge having a profile in the form of a continuous curve having two waves starting from the rearward projection and continuing forward through a first trough to a first crest, said first trough having a depth at its deepest point not deeper than 5/10 of said elevation ($h_1$), said first crest having a highest point at an elevation lower than said elevation ($h_1$);

said profile continuing from said first crest through a second trough to a second crest; and, said second crest having a highest point lying in the front half of said safety member, said highest point of said second crest extending upwardly at most to a point on a second line (X–X') parallel to said first line and touching said highest point of said top edge of said projection.

2. The saw chain of claim 1, said highest point of said first crest and said highest point of said second crest lying in the region between said rivet openings.

3. The saw chain of claim 2, said highest point of said first crest being disposed at a horizontal spacing from the rearward rivet opening and said highest point of said second crest being disposed at a horizontal spacing from said forward rivet opening equal to said first mentioned horizontal spacing.

4. The saw chain of claim 3, said deepest point of said first trough being located approximately above the center of said rearward rivet opening and said second trough having a deepest point located approximately above the midpoint between said rivet openings.

5. The saw chain of claim 4, said elevation ($h_1$) being approximately 5/6 to 9/10 of the elevation of the highest point of said depth limiter of said cutting link.

6. The saw chain of claim 5, the elevation of said highest point of said second crest corresponding to 7/10 to 9/10 of the elevation of said highest point of said depth limiter; and, the highest elevation of the said first crest corresponds to approximately one-half of the sum: of the elevation of said highest point of said projection and the elevation of said highest point of said second crest.

7. The saw chain of claim 6, said elevation of said highest point of said first crest corresponding approximately to 6/7 of said highest elevation of said depth limiter.

8. The saw chain of claim 7, said highest point of said first crest being located at a distance of 1/6 to $\frac{1}{3}$ of the distance between the centers of said rivet openings measured from the center of the rearward rivet opening.

9. The saw chain of claim 7, the radius of the profile of said first crest being 1/10 to 3/10 of the distance between the centers of said rivet openings.

10. The saw chain of claim 9, at least one of said deepest points of said troughs, respectively, being at a spacing from said highest point of said top edge of said projection a distance in elevation equal to or greater than 2/10 of the elevation of said highest point of said depth limiter.

11. The saw chain of claim 10, said projection extending rearwardly a distance of 3/9 to 5/9 of the distance between the centers of said rivet openings measured from a line passing through the center of said rearward rivet opening and perpendicular to said first line passing through the centers of said rivet openings.

12. The saw chain of claim 1, said depth limiter of said cutting link having a forward convex profile, said cutting link and said safety link being pivotally connected to each other so as to cause the spacing between said profiles to be a minimum.

13. The saw chain of claim 1, said continuous curve being a sinusoid.

14. A saw chain for a chain saw, the saw chain comprising:

a plurality of cutting links, a plurality of safety links, a plurality of side connecting links, and a plurality of driving links, the links being pivotally interconnected by rivets or the like to define the saw chain with a first portion of said cutting links and a first portion of said safety links being arranged on one side of the saw chain and the remaining portion of said cutting links and the remaining portion of said safety links being arranged on the other side of the saw chain;

each one of the cutting links including: a plate-like body having an upwardly extending rearward bent-over top portion defining the cutting tooth of the cutting link; a forward upwardly extending portion defining the depth limiter of the cutting link; and, said cutting tooth having a cutting edge at an elevation above said depth limiter;

said safety links corresponding to respective ones of said cutting links;

each one of said safety links being pivotally connected at its rearward end to the forward end of the cutting link corresponding thereto and being disposed on a side of the saw chain opposite from the side thereof on which said corresponding cutting link is disposed;

said safety link having a plate-like body with a projection extending outwardly and rearwardly therefrom so as to be at an elevation less than the depth limiter of said corresponding cutting link;

said safety link having a top edge extending over the length thereof, said top edge having a profile in the form of continuous curve means starting from said projection and continuing forward through a plurality of alternating troughs and crests to the forward end of said safety link; and, said depth limiter of said cutting link having a forward convex profile, said cutting link and said safety link being pivotally connected to each other so as to cause the spacing between said profiles to be a minimum.

* * * * *